US010284989B2

(12) United States Patent
Song et al.

(10) Patent No.: US 10,284,989 B2
(45) Date of Patent: May 7, 2019

(54) METHOD AND DEVICE FOR PLAYING 3D SOUND

(71) Applicant: Samsung Electronics Co., Ltd., Suwon-si, Gyeonggi-do (KR)

(72) Inventors: Seongwook Song, Seoul (KR); Hangil Moon, Daejeon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/120,375

(22) PCT Filed: Feb. 25, 2015

(86) PCT No.: PCT/KR2015/001842
§ 371 (c)(1),
(2) Date: Aug. 19, 2016

(87) PCT Pub. No.: WO2015/130086
PCT Pub. Date: Sep. 3, 2015

(65) Prior Publication Data

US 2017/0064485 A1 Mar. 2, 2017

(30) Foreign Application Priority Data

Feb. 25, 2014 (KR) ..... 10-2014-0021952

(51) Int. Cl.
*H04S 7/00* (2006.01)
*H04R 5/02* (2006.01)
*H04S 5/02* (2006.01)

(52) U.S. Cl.
CPC ..... *H04S 5/02* (2013.01); *H04R 5/02* (2013.01); *H04S 7/301* (2013.01); *H04S 7/302* (2013.01);
(Continued)

(58) Field of Classification Search
CPC ..... H04S 2420/01; H04S 2400/11; H04S 2400/01; H04R 5/033
(Continued)

(56) References Cited

U.S. PATENT DOCUMENTS 8,788,080 B1 * 7/2014 Kallai ..... H04R 27/00 700/94
2003/0031333 A1 2/2003 Cohen et al.
(Continued)

FOREIGN PATENT DOCUMENTS

JP 2008-546245 A 12/2008
JP 2008-546345 A 12/2008
KR 10-0927637 B1 11/2009

*Primary Examiner* — Alexander Jamal
(74) *Attorney, Agent, or Firm* — Jefferson IP Law, LLP

(57) ABSTRACT

The present invention relates to a device and a method for playing 3D sound by means of a speaker and one or more microphones. A method for playing 3D sound according to the present invention comprises the steps of: receiving through wire or wireless communication a first signal which is an audio signal comprising any one of left direction information and right direction information and a second signal which is an audio signal comprising the other one of the left direction information and the right direction information; receiving through microphones a third signal that is being output from an external speaker; determining, on the basis of a fourth signal that is to be output from the speaker; and generating the fourth signal from the second signal by means of the determined variable.

14 Claims, 6 Drawing Sheets

(52) U.S. Cl.
CPC ..... *H04R 2460/13* (2013.01); *H04R 2499/11* (2013.01); *H04S 2400/01* (2013.01); *H04S 2400/11* (2013.01); *H04S 2420/01* (2013.01)

(58) Field of Classification Search
USPC ..... 381/310, 309, 307, 17
See application file for complete search history.

(56) References Cited

U.S. PATENT DOCUMENTS

| | | | | |
|---|---|---|---|---|
| 2008/0056503 | A1 | 3/2008 | McGrath | |
| 2008/0304361 | A1 | 12/2008 | Peng et al. | |
| 2010/0135118 | A1 | 6/2010 | Van Leest et al. | |
| 2013/0156198 | A1* | 6/2013 | Kim | H04R 1/323 381/17 |
| 2013/0157721 | A1* | 6/2013 | Nystrom | G01B 7/003 455/566 |
| 2013/0216071 | A1* | 8/2013 | Maher | H04R 3/04 381/303 |

* cited by examiner

METHOD AND DEVICE FOR PLAYING 3D SOUND

TECHNICAL FIELD

The present invention relates to a method and a device for reproducing a stereophonic sound and. more particularly, to a method and a device for reproducing a stereophonic sound by using a single speaker and at least one external speaker.

BACKGROUND ART

A stereophonic sound is a signal having an excellent directional property in terms of realism and immersion. A basic idea of providing a stereophonic sound is to add an IID (Interaural Intensity Difference), ITD (Interaural Time Delay), and pinna effect to a sound signal to be transferred through signal processing, which is used for a person to identify the directionality of a signal in a 3-dimensional space.

The methods of providing a stereophonic sound may be divided into a method of using a headphone and a method of using a speaker.

The method of using a headphone cannot be applied to a single speaker, and if a listener is moving or the distance between the listener and the speaker changes there are limitations in the method of using a speaker to play a stereophonic sound.

Technical Problem

The present invention has been designed to solve the above problems and has an object to provide a method and a device for playing a stereophonic sound.

Solution to Problem

In order to solve the above problems, a method for playing a stereophonic (3D) sound in a portable device having a first speaker and a microphone according to the present invention comprises receiving an audio signal including one of left direction information and right direction information as a first signal and an audio signal including the other one of the left direction information and the right direction information as a second signal from a media playing device through wired or wireless communication, receiving a third signal output by a second speaker of the media playing device through the microphone, determining a compensation parameter for a fourth signal to be output through the first speaker on the basis of the first signal and the third signal, and generating the fourth signal from the second signal by using the determined compensation parameter.

Further, a method for playing a stereophonic (3D) sound in a media playing device according to the present invention comprises transmitting an audio signal including one of right directionality information and left directionality information as a first signal and an audio signal including the other one of the right directionality information and the left directionality information as a second signal to a portable device through wired or wireless communication and outputting the first signal to an external speaker after processing the signal on the basis of information received from the portable device.

Further, a portable stereophonic (3D) sound playing device having a first speaker according to the present invention comprises a wireless communication unit configured to receive an audio signal including one of right directionality information and left directionality information as a first signal and an audio signal including the other one of the right directionality information and the left directionality information as a second signal from a media playing device through wired or wireless communication, a microphone configured to receive a third signal from a second speaker of the media playing device, and a signal processing unit configured to generate a fourth signal from the second signal by determining a compensation parameter of the fourth signal to be output to the first speaker on the basis of the first signal and the third signal.

Further, a media playing device for playing a stereophonic sound according to the present invention comprises a wireless communication unit configured to transmit an audio signal including one of right directionality information and left directionality information as a first signal and an audio signal including the other one of the right directionality information and the left directionality information as a second signal to a portable device through wired or wireless communication and an audio processing unit configured to output the first signal after processing the signal on the basis of information received from the portable device.

Advantageous Effects of Invention

According to the present invention, a stereophonic sound can be played by using a single speaker and one or more external speakers.

Further, according to the present invention, a high quality stereophonic sound can be played by using a feedback of a wireless communication unit even though a location of a listener wearing a speaker changes.

Further, according to the present invention, a stereophonic sound can be played with a bone conduction speaker by eliminating an interference signal.

MODE FOR THE INVENTION

Figure 1:
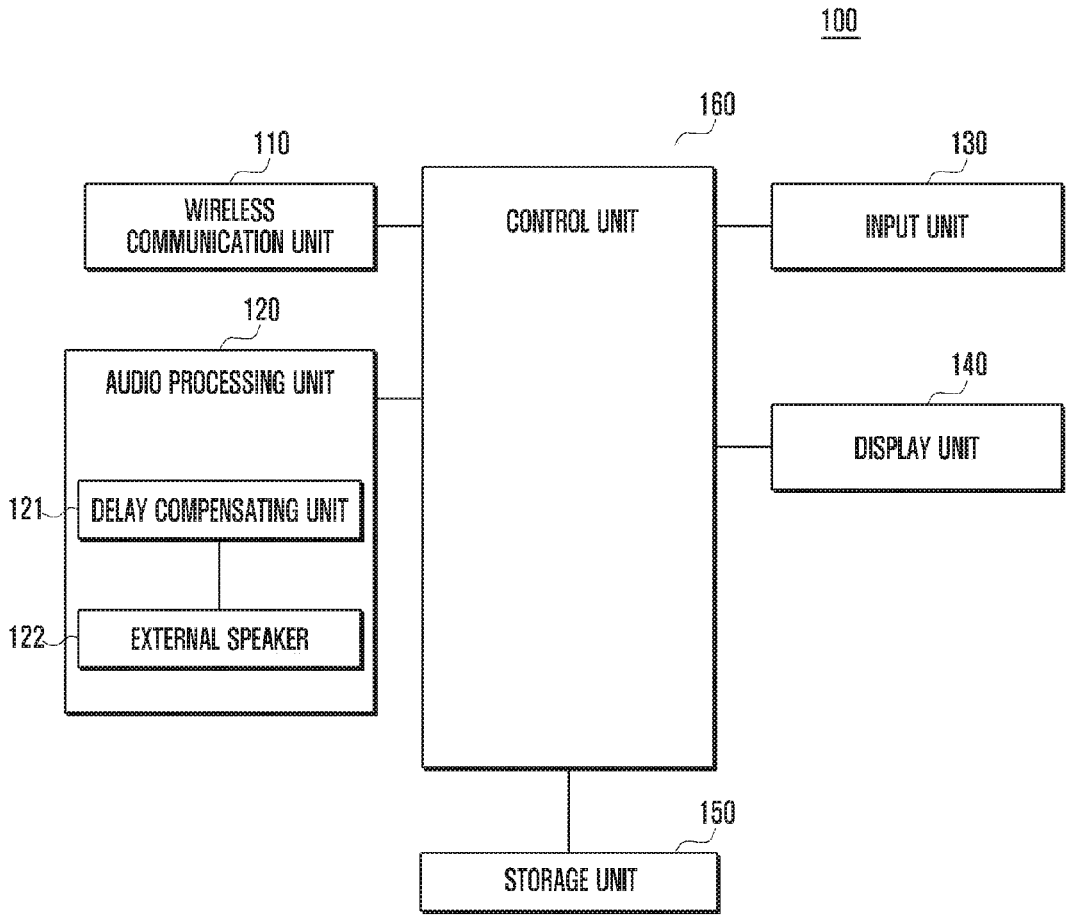
FIG. 1 is a block diagram illustrating a configuration of a media playing device according to an embodiment of the present invention.

Hereinafter, embodiments of the present invention are described in detail with reference to the accompanying drawings. The same reference symbols are used throughout the drawings to refer to the same or like parts. Detailed descriptions of well-known functions and structures incorporated herein may be omitted to avoid obscuring the subject matter of the present invention.

For the same reason, some components in the accompanying drawings are emphasized, omitted, or schematically illustrated, and the size of each component does not fully reflect the actual size. Therefore, the present invention is not limited to the relative sizes and distances illustrated in the accompanying drawings.

The following description with reference to the accompanying drawings is provided to assist in a comprehensive understanding of various embodiments of the present invention as defined by the claims and their equivalents. It includes various specific details to assist in that understanding, but these are to be regarded as merely exemplary. Accordingly, those of ordinary skill in the art will recognize that various changes and modifications of the embodiments described herein can be made without departing from the scope and spirit of the present invention. In addition, descriptions of well-known functions and constructions may be omitted for clarity and conciseness.

In order to provide a stereophonic sound, a HRTF (Head Related Transfer Function) database modeled by reflecting factors used for identifying directionality such as an IID (Interaural Intensity Difference) between both ears, ITD (Interaural Time Delay) between both ears, and pinna effect can be used. The HRTF database is configured with a plurality of HRTFs measured for the horizontal and vertical directions on the basis of a location of a listener's head. The HRTF measured as a spatial transfer function may utilize a database disclosed by major research centers.

In more detail, the principal is to output a sound to a listener's right and left ear by applying the HRTF for a channel between a sound source and the listener's ears to a sound signal through signal processing. In this case, the methods of playing a stereophonic sound may be divided into a method of using a headphone and a method of using a speaker.

First, a method for playing a stereophonic sound by using a headphone will be briefly described.

In case of using a headphone, 5 channels and HRTF databases (left: 5 and right: 5) corresponding to a transfer function between both ears of a listener are required to transmit a stereophonic sound by using a 5.1 channel input signal. If C, L, R, Ls, and Rs are defined as channel signals respectively of center, left, right, left surround, and right surround, $hr_{Cl}$ is defined as a HRTF from a center channel to the left ear, $hr_{Cr}$ is defined as a HRTF from the center channel to the right ear, $hr_{Ll}$ is defined as a HRTF from a left channel to the left ear, $hr_{Lr}$ is defined as a HRTF from the left channel to the right ear, $hr_{Rl}$ is defined as a HRTF from the right channel to the left ear, $hr_{Rr}$ is defined as a HRTF from the right channel to the right ear, $hr_{LSl}$ is defined as a HRTF from a left surround channel to the left ear, $hr_{LSr}$ is defined as a HRTF from the left surround channel to the right ear, $hr_{RSr}$ is defined as a HRTF from a right surround channel to the right ear, and $hr_{RSl}$ is defined as a HRTF from the right surround channel to the left ear. A left signal $s_L(t)$ and a right signal $s_R(t)$ of the headphone for a stereophonic sound can be expressed in Formula 1.

$$s_L(t)=C*hr_{Cl}+L*hr_{Ll}+R*hr_{Rl}+L_S*hr_{LSl}+R_S*hr_{RSl}$$

$$s_R(t)=C*hr_{Cr}+L*hr_{Lr}+R*hr_{Rr}+L_S*hr_{LSr}+R_S*hr_{RSr}$$

The stereophonic sound can be played by transmitting the left signal $s_L(t)$ to the left side of the headphone (i.e., listener's left ear) and the right signal $s_R(t)$ to the right side of the headphone (i.e., listener's right ear).

Next, a method for playing a stereophonic sound by using left and right speakers will be described.

A signal $y_R(t)$ transmitted from a speaker to the right ear and a signal $y_L(t)$ transmitted from the other speaker to the left ear can be expressed as shown by Formula 2.

$$y_R(t)=h_{RR}s_R(t)+h_{LR}s_L(t)$$

$$y_L(t)=h_{RL}s_R(t)+h_{LL}s_L(t)$$

Here, $h_{RR}$ and $h_{LR}$ indicate channel responses from right and left speakers to the right ear and $h_{LL}$ and $h_{RL}$ indicate channel responses from the left and right speaker to the left ear. In case of using a speaker, signals other than desired signals must be removed because signals of both speakers are recognized by the right and left ears through a spatial transfer path (crosstalk cancellation). For playing effectively a stereophonic sound, sections including a crosstalk must be removed, and accordingly additional signal processing is required for the output signals $y_R(t)$ and $y_L(t)$. Here, if signal processing parameters suitable for removing sections including $h_{LR}$ and $h_{RL}$ are defined as $p_{00}$, $p_{01}$, $p_{10}$, and $p_{11}$, the output signal can be expressed in the formula y=HPs. Vectors and matrixes being used for this formula are defined as follows.

$$y=\begin{pmatrix} y_R(t) \\ y_L(t) \end{pmatrix} s=\begin{pmatrix} S_R(t) \\ S_L(t) \end{pmatrix} P=\begin{pmatrix} p_{00} & p_{01} \\ p_{10} & p_{11} \end{pmatrix} H=\begin{pmatrix} h_{RR} & h_{LR} \\ h_{RL} & h_{LL} \end{pmatrix}$$

Because conditions for removing a crosstalk are $y_R(t)=s_R(t)$ and $y_L(t)=s_L(t)$, the condition for removing a crosstalk becomes $P=H^{-1}$.

A method and a device for playing a stereophonic sound according to the present invention may include a media playing device 100 having at least one external speaker and a portable device 200 having a speaker and at least one microphone.

FIG. 1 is a block diagram illustrating a configuration of a media playing device according to an embodiment of the present invention.

As shown in FIG. 1, the media playing device 100 according to the present invention may include a wireless communication unit 110, audio processing unit 120, input unit 130, display unit 140, storage unit 150, and control unit 160.

The media playing device 100 according to the present invention may include all devices that have a communication function and enable the playing of video data including an audio signal. For example, a TV, desktop computer, mobile phone, tablet PC, and smartphone may be applied to the media playing device; however, the present invention is not limited to these examples.

The wireless communication unit 110 transmits and receives data through wireless communication. The wireless communication unit 110 performs a series of operations for transmitting and receiving a control signal and an audio signal through a wireless interface. The wireless communication unit 110 may use communication methods such as Bluetooth, infrared, and Zigbee; however, the wireless communication is not limited to one of these methods. Further, the wireless communication unit 110 can output data received through the wireless communication to the control unit 160 and transmit data output by the control unit 160 through the wireless communication.

The audio processing unit 120 may include an audio codec for performing signal processing of an audio signal. Further, the audio processing unit 120 may include an external speaker 122 for outputting an analog audio signal and a delay compensating unit 121 for processing an audio signal to be output to the external speaker 122. The processing of an audio signal to be output to the external speaker 122 may include an operation of delaying an output of a signal. Further, the delay compensating unit 121 can receive values required for signal processing through the wireless communication unit 110.

The input unit 130 receives a user operation for controlling the media playing device 100 according to the present invention and generates an input signal to transmit to the control unit 160. The input unit 130 may be located in the media playing device 100 or can transmit an input signal remotely through wired or wireless communication. Further, the input unit 130 can be omitted if the present invention is applied to a media playing device having a touch screen and all the operations can be performed with the touch screen.

The display unit 140 may be configured with an LCD (Liquid Crystal Display), OLED (Organic Light Emitting Diodes), or AMOLED (Active Matrix Organic Light Emitting Diodes). The display unit 140 provides visually menus of the media playing device 100, input data, and various media play information for a user.

The display unit may include a touch screen. The touch screen may include a touch sensor. The touch sensor detects a user's touch input. The touch sensor may be configured with a touch detection sensor such as a capacitive overlay, resistive overlay, and infrared beam, or may be configured with a pressure sensor. The touch sensor detects a user's touch input and generates a detection signal to transmit to the control unit 160. The detection signal may include coordinate data of the user's touch input.

The media playing device 100 of the present invention may be configured with a touch screen as described above; however, embodiments of the present invention described hereafter may not be limited to the media playing device 100 having a touch screen.

The storage unit 150 stores programs and data required for operating the media playing device 100 and may be divided into a program area and a data area.

The program area can store programs for controlling general operations of the media playing device 100, OS (Operating System) for booting the media playing device 100, application programs required for playing multimedia contents, and other optional functions of the media playing device 100.

The control unit 160 controls general operations of each component of the media playing device 100. In particular, the control unit 160 can control operations of the delay compensating unit 121 installed in the audio processing unit 120 and an audio signal being output to the external speaker 122 when the media playing device 100 plays a stereophonic sound.

Figure 2:
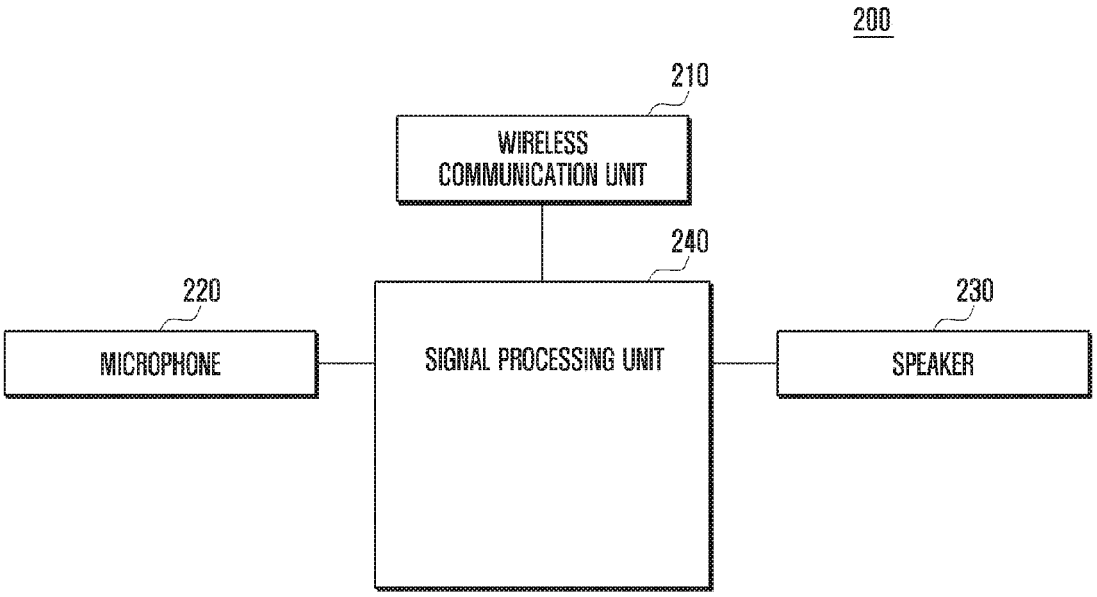
FIG. 2 is a block diagram illustrating a configuration of a portable device according to an embodiment of the present invention.

FIG. 2 is a block diagram illustrating a configuration of a portable device 200 according to an embodiment of the present invention.

According to FIG. 2, the portable device 200 of the present invention may include a wireless communication unit 210, microphone 220, speaker 230, and signal processing unit 240.

The wireless communication unit 210 transmits and receives data through wireless communication. The wireless communication unit 210 performs a series of operations for transmitting and receiving a control signal and an audio signal for a portable device through a wireless interface. The wireless communication unit 210 may utilize one of Bluetooth, infrared, and Zigbee communication systems; however, the wireless communication system 210 is not limited to these systems. Further, the wireless communication unit 210 can output data received from the wireless communication to the signal processing unit 240 and transmit data output by the signal processing unit 240 through the wireless communication.

The microphone 220 can transmit an audio signal to the signal processing unit 240 by receiving from the external speaker 122 of the media playing device 100. Further, the portable device of the present invention may include a plurality of microphones, and audio signals received from each microphone are transmitted to the signal processing unit 240.

The speaker 230 outputs an audio signal processed by the signal processing unit 240. The speaker 230 of the portable device according to the present invention may be a single speaker which is worn at one of ears.

The signal processing unit 240 may be called a control unit. The signal processing unit 240 can estimate an imbalance parameter between an audio signal received through the wireless communication unit 210 and an audio signal received through the microphone 220. For example, the signal processing unit 240 can estimate an imbalance parameter between signals of microphone 220 received in an audible frequency band and right and left signals of a stereophonic sound received through the wireless communication unit 210. The imbalance parameter may include parameters such as a volume, echo, background noise difference, and frequency response difference.

Further, the signal processing unit 240 can determine a compensation parameter for compensating a signal to be output to the speaker 230 by using an extracted imbalance parameter. The signal processing unit 240 can generate a signal to be output to the speaker 230 by modifying some parts of an audio signal received through the wireless communication unit 210 according to the determined compensation parameter.

Although the portable device of FIG. 2 has been described on the basis of a headset type having a single speaker and a microphone, the present invention is not limited to this example and can be applied also to a portable device configured in an eyeglasses type.

Figure 3:
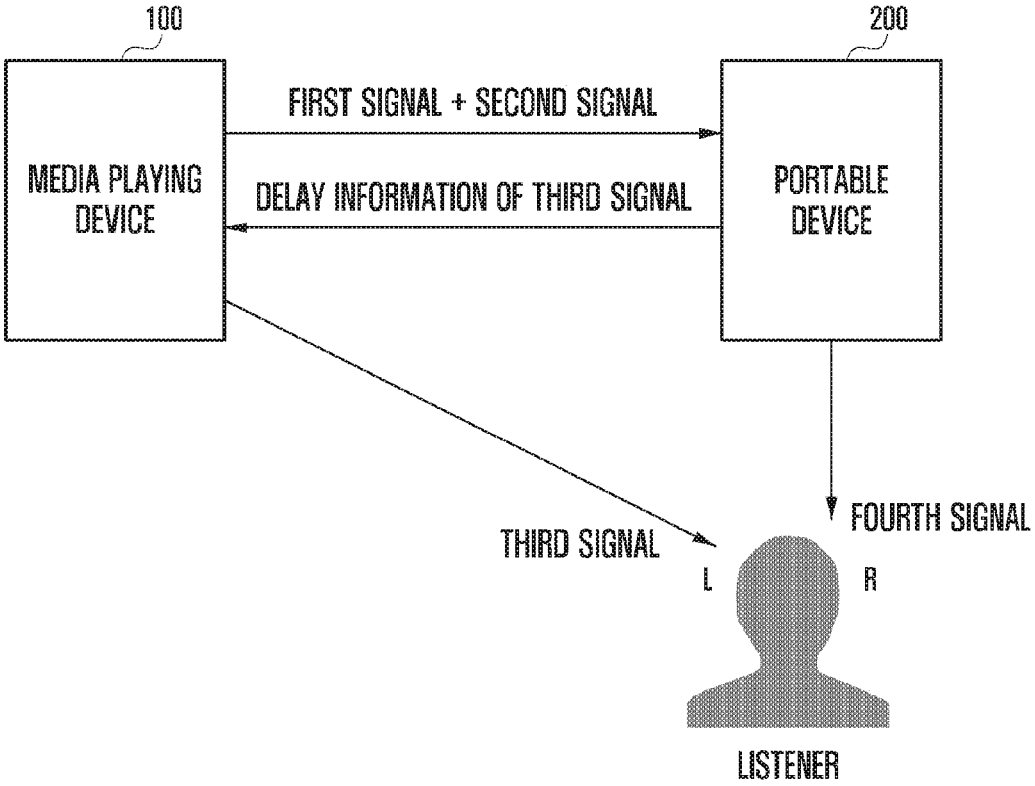
FIG. 3 is a schematic drawing illustrating a principle of playing a stereophonic sound.

FIG. 3 is a schematic drawing illustrating a principle of playing a stereophonic sound.

In FIG. 3, it is assumed that a listener wears at the right ear the speaker 230 of the portable device according to the present invention. Namely, it is assumed that the portable device and the listener have the same transfer path related to an audio signal transmitted by the media playing device.

Providing a stereophonic sound can be achieved by processing an audio signal with a transfer function reaching to the right or left ear of a listener and transmitting the processed audio signal to each ear of the listener. The transfer function reaching to the right or left ear of the listener can be selected from a HRTF (Head Related Transfer Function) database on the basis of a location of a listener who wears the portable device of the present invention.

Hereafter, it is assumed that a signal processed with HRTF reaching to the left ear of a listener is a first signal and a signal processed with HRTF reaching to the right ear of the listener is a second signal. Namely, the first signal is an audio signal including left directionality information and the second signal is an audio signal including right directionality information. In order to provide a high performance stereophonic sound, the first signal must be transmitted to the left ear of the listener and the second signal must be transmitted to the right ear of the listener. The right ear of the listener directly receives a signal output by the speaker 230 of the portable device according to the present invention (for example, an earphone type) and the left ear of the listener receives a signal output by the external speaker 122 of the media playing device 100 according to the present invention.

Accordingly, in order to provide signals transmitted to both ears in a stereophonic sound, the signals to be output by the speaker 230 and the external speaker 122 require proper signal processing.

First, the media playing device 100 transmits a first signal and a second signal to a portable device according to the present invention through the wireless communication unit 110. Further, the control unit 160 transmits the first signal to the audio processing unit 120 in order to output to the external speaker 122.

The audio processing unit 120 can output a third signal to the external speaker 122. The audio signal output to the external speaker can be received by the microphone 220 of the portable device. Differently from the signal transmitted to the portable device through the wireless communication unit 110, the signal transmitted from the external speaker 122 to the portable device is transmitted in an audible frequency band.

The delay compensating unit 121 can perform a proper pre-processing to output a signal to the external speaker 122. The delay compensating unit 121 can perform processing in various ways for a signal to be output, and the most typical processing is a delay compensation.

If the distance between the external speaker 122 of the media playing device 100 and the microphone 220 of the portable device is great, problems may be generated because of an arrival time difference between the first signal output by the external speaker 122 and the second signal received by the microphone 220 of the portable device. This is because the third signal is transmitted in the sound velocity differently from the first signal which is transmitted electronically. In this case, the signal processing unit 240 installed in the portable device according to the present invention can transmit data related to the delay time of the third signal to the media playing device 100 through the wireless communication unit 210.

The control unit 160 receives data related to the delay time from the portable device and transmits the data to the audio processing unit 120. The delay compensating unit 121 installed in the audio processing unit 120 compensates the third signal by using the data related to the delay time and outputs the third signal to the external speaker 122.

In the meantime, the wireless communication unit 210 of the portable device receives a first signal and a second signal from the media playing device 100. The received signals are then transmitted to the signal processing unit 240.

Further, the microphone 220 receives an audio signal (third signal) output by the external speaker 122 of the media playing device 100 and transmits the audio signal to the signal processing unit 240.

Because the distance between the microphone 220 and the left ear of the listener is very close, the signal received by the microphone 220 and the signal received by the left ear of the listener may be considered as identical signals. Hereinafter, the signal output by the external speaker 122 of the media playing device 100 and received by the left ear of the listener may be called a third signal, which is the same as the signal received by the microphone 220.

The signal processing unit 240 can estimate various imbalance parameters from the difference between the first signal received through the wireless communication unit 210 and the third signal received through the microphone 220. A compensation parameter is determined by using the estimated imbalance parameters, and signal processing is performed by applying the compensation parameter to the second signal. A signal (hereinafter, fourth signal) processed by using the compensation parameter is output through the speaker 230.

The left ear of the listener receives the third signal from the external speaker 122 and the right ear of the listener receives the fourth signal from the speaker 230. The fourth signal is a signal processed from the second signal by using the compensation parameter. Accordingly, a stereophonic sound can be played for the listener through the external speaker 122 and the speaker 230.

Figure 4:
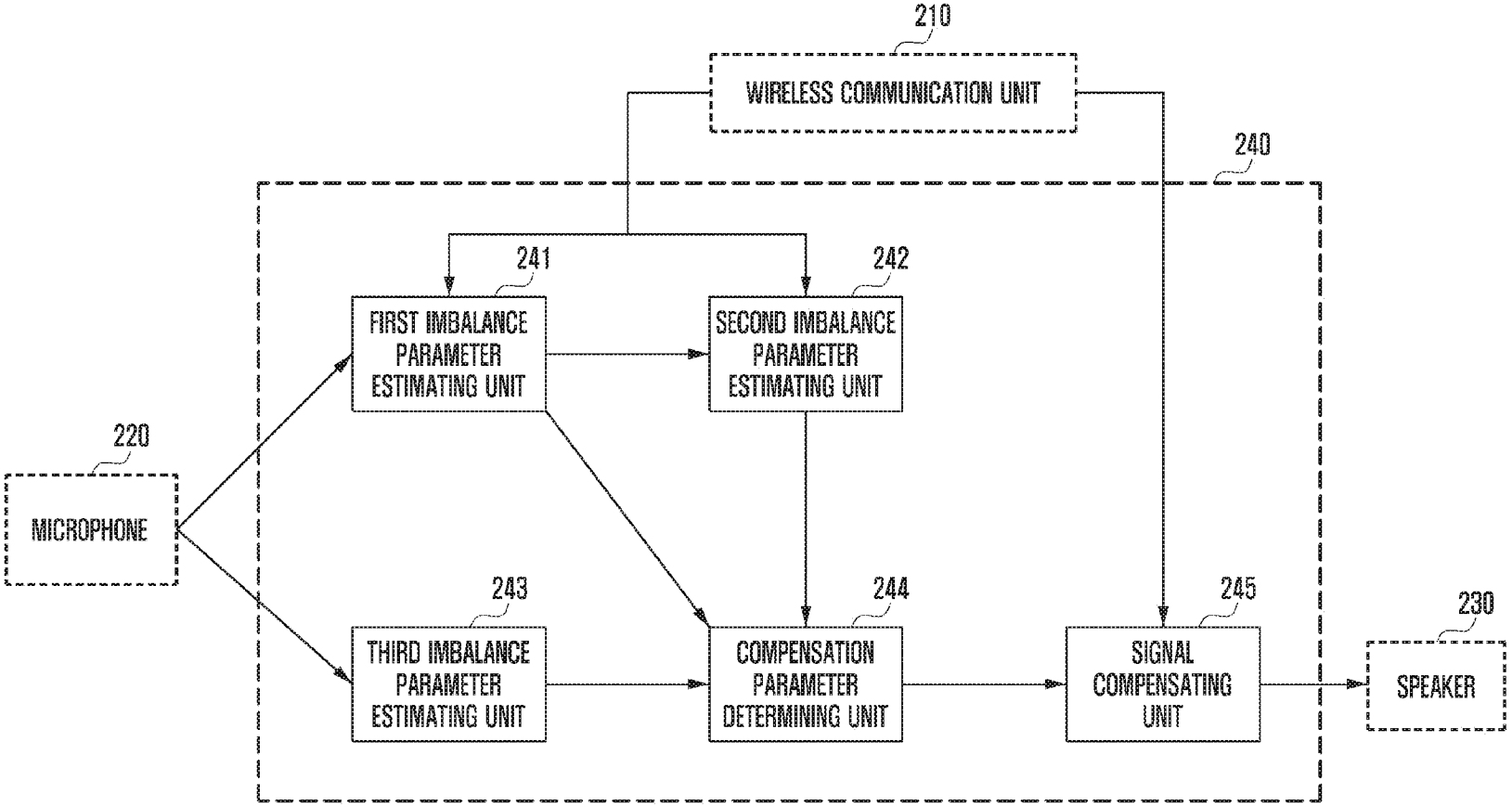
FIG. 4 is a block diagram illustrating a configuration of a signal processing unit in a portable device according to an embodiment of the present invention.

FIG. 4 is a block diagram illustrating a configuration of a signal processing unit 240 in a portable device 200 according to an embodiment of the present invention.

According to FIG. 4, the signal processing unit 240 of the present invention may include a first imbalance parameter estimating unit 241, second imbalance parameter estimating unit 242, third imbalance parameter estimating unit 243, compensation parameter determining unit 244, and signal compensating unit 245. The signal flows between each unit shown in FIG. 4 are only an example, and the signals may be transmitted in a different way.

The first imbalance parameter estimating unit 241 is a device configured to estimate a channel between the external speaker 122 and a listener, and a channel response between the external speaker 122 and the microphone 220 can be obtained by comparing the first signal transmitted through the wireless communication unit 210 and the third signal received through the microphone 220. Delay information according to the distance between the microphone 220 and the external speaker 122, location correlation between the external speaker 122 and the microphone 220, and frequency response characteristics can be estimated from the channel response. The first imbalance parameter estimating unit 241 transmits data related to the channel response (i.e., estimated imbalance parameter) to the compensation parameter determining unit 244.

The second imbalance parameter estimating unit 242 estimates a noise being added to a first signal while the first signal is transmitted from the external speaker 122 through a spatial transfer path. The first signal output through the external speaker 122 is transmitted to an ear of the listener with a background noise; however, the third signal output through the speaker 230 includes only the audio signal without the background noise. Accordingly, the imbalance of the audio signals reaching both ears of the listener can be resolved by adding the background noise to the third signal. The second imbalance parameter estimating unit 242 transmits the data related to the estimated background noise to the compensation parameter determining unit 244.

The third imbalance parameter estimating unit 243 estimates the intensity of a signal received through the microphone 220. A gain of a signal output to the speaker 230 can be adjusted corresponding to the audio signal intensity transmitted to the left ear of the listener by using data related to the signal intensity estimated by the third imbalance parameter estimating unit 243. The third imbalance parameter estimating unit 243 transmits the data related to the estimated signal intensity to the compensation parameter determining unit 244.

The compensation parameter determining unit 244 determines a compensation parameter for compensating the second signal by receiving imbalance parameters estimated by the first imbalance parameter estimating unit 241, second imbalance parameter estimating unit 242, and third imbalance parameter estimating unit 243. The compensation parameter determining unit 244 transmits the determined compensation parameter to the signal compensating unit 245.

The signal compensating unit 245 can compensate the second signal to be output through the speaker worn at the right ear among the first signal and the second signal received through the wireless communication unit 210. In more detail, the signal compensating unit 245 generates a fourth signal by compensating the second signal so that the fourth signal includes a signal level and a background noise similar to those of the third signal reaching the left ear. The fourth signal generated by the signal compensating unit 245 is output through the speaker 230 and transmitted to the right ear of the listener.

Hereinafter, a method for playing a stereophonic sound in a portable device is described in more detail with reference to FIGS. 5 and 6.

Figure 5:
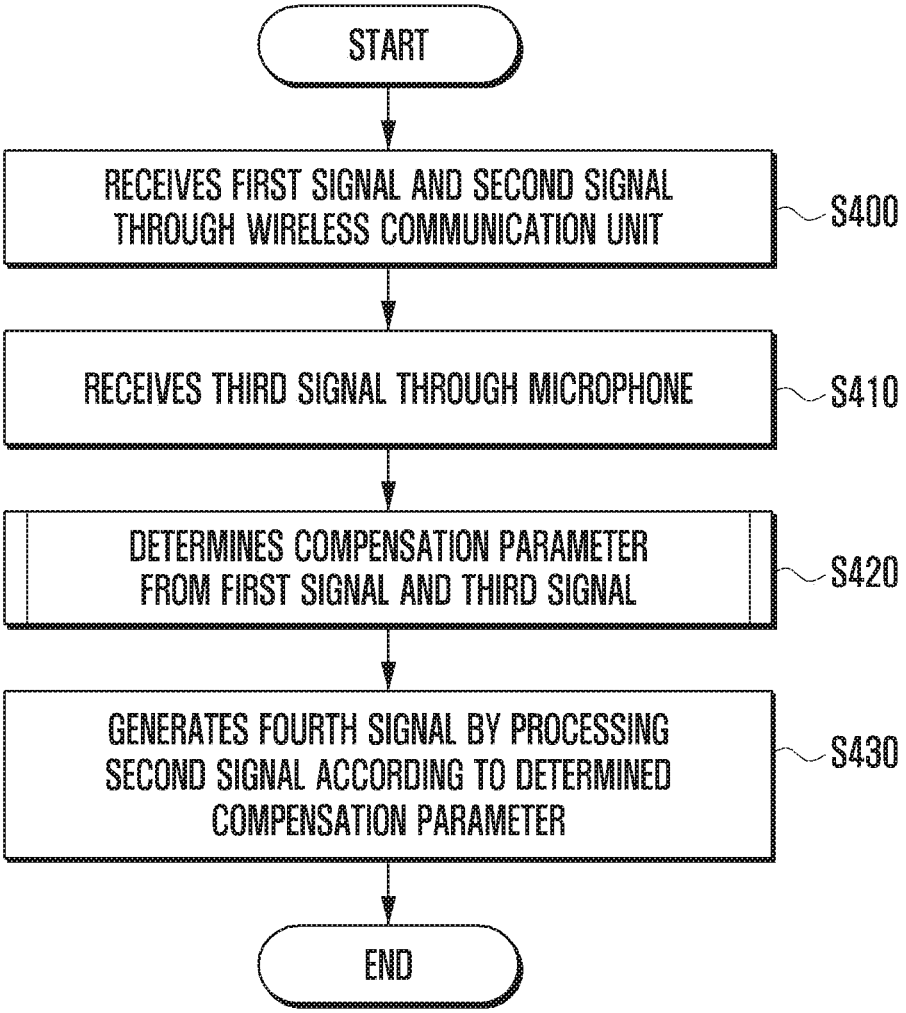
FIG. 5 is a flowchart illustrating a procedure of generating a speaker output signal in a portable device according to an embodiment of the present invention.
Figure 6:
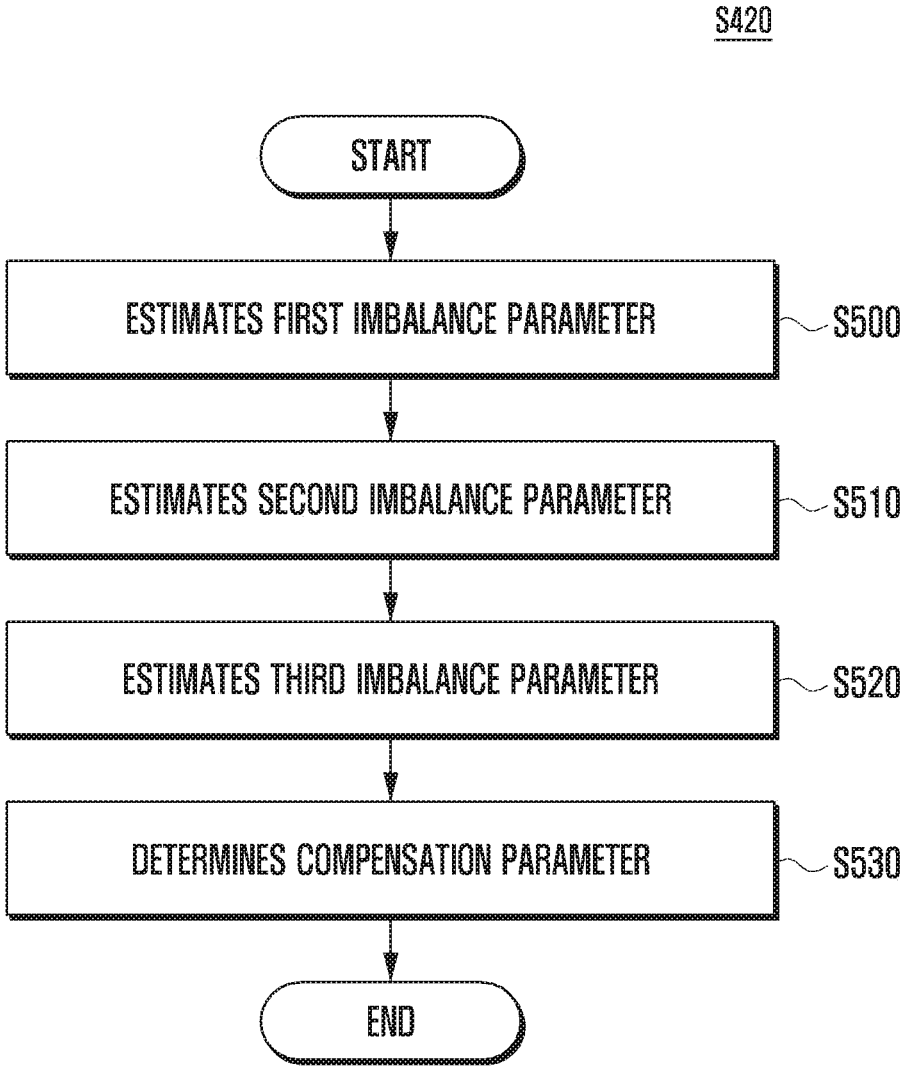
FIG. 6 is a flowchart illustrating a procedure of determining a compensation parameter according to an embodiment of the present invention.

FIG. 5 is a flowchart illustrating a procedure of generating a speaker output signal in a portable device according to an embodiment of the present invention, and FIG. 6 is a flowchart illustrating a procedure of determining a compensation parameter according to an embodiment of the present invention.

The portable device according to the present invention may be configured with a headset including a single speaker and a microphone; however, the portable device is not limited to this configuration. A wearable device can be applied to the portable device. For example, the wearable device may be configured with glasses, watch, bracelet, anklet, band, necklace, shoes, clothing, gloves, socks, contact lens, sports equipment, or medical equipment (medical diagnostic device). The wearable device can be attached to the skin of the human body or transplanted in the human body. The speaker used for the portable device may include a normal speaker unit blocking an external noise or a bone conduction speaker unit (leaky headphone unit) speaker allowing an inflow of an adjacent signal into an ear.

If the normal speaker unit is used for the portable device, a signal transmitted from the external speaker 122 to the speaker 230 is very weak and thereby can be disregarded.

If the first signal transmitted to the left ear of the listener is defined as $s_L(t)$, the second signal transmitted to the right ear of the listener is defined as $s_R(t)$, and the outputs of the external speaker 122 and the speaker 230 are defined respectively as $y_L(t)$ and $y_R(t)$, an output value of the speaker 230 before compensation can be expressed as shown by Formula 3.

$$y_R(t)=s_R(t)$$

$$y_L(t)=hs_L(t)$$

In Formula 3, h indicates a channel (channel response) between the external speaker 122 and the left ear.

The wireless communication unit 210 of the portable device receives a first signal and a second signal from the media playing device 100 at step S400.

The left ear and the microphone 220 receives an audio signal output by the external speaker 122 of the media playing device 100. The external speaker 122 outputs a first signal to transmit to the left ear at step S410, and the signal reaching to the left ear or the microphone 220 is a third signal of which a background noise is added to the first signal in a spatial transfer path. If the background noise is defined as i(t), the third signal is expressed as shown by the following Formula 4.

$$y_L(t)=hs_L(t)+i(t)$$

The signal processing unit 240 of the portable device estimates an imbalance parameter from the first signal received through the wireless communication unit 210 and the third signal received through the microphone 220 at step S420.

A method for estimating the imbalance parameter from the first signal and the third signal is described in more detail with reference to FIG. 6.

According to FIG. 6, the first imbalance parameter estimating unit 241 estimates a first imbalance parameter by using the channel response between the first signal and the third signal at step S500.

The estimation of the first imbalance parameter is expressed as shown in the following Formula 5.

$$\hat{h}=\frac{\int y_L(t)s_L(t)dt}{\int |s_L(t)|^2 dt}$$

$$\hat{h}=\frac{\Sigma y_L[n]s_L[n]}{\Sigma |s_L[n]|^2}$$

Namely, the first imbalance parameter estimating unit 241 estimates the first imbalance parameter by sampling a signal having a correlation with the first signal (signal transmitted to the left ear).

The second imbalance parameter estimating unit 242 estimates a background noise to be added to the second signal from the background noise included in the third signal at step S510. The background noise is expressed as shown by the following Formula 6.

$$\hat{i}(t)=y_L(t)-\hat{h}s_L(t)$$

Further, the third imbalance parameter estimating unit 243 estimates an output level suitable for the second signal from the intensity of the third signal received through the microphone 220 at step S520.

The compensation parameter determining unit 244 determines a compensation parameter for compensating the second signal by receiving each parameter estimated by the first imbalance parameter estimating unit 241, second imbalance parameter estimating unit 242, and the third imbalance parameter estimating unit 243 at step S530. The determined compensation parameter is transmitted to the signal compensating unit 245.

The signal compensating unit 245 generates a fourth signal by compensating the second signal according to the estimated parameters at step S430. The generated fourth signal is expressed as shown by the following Formula 7.

$$y_R(t)=\hat{h}s_R(t)+\hat{i}(t)$$

The fourth signal generated by the signal compensating unit 245 to have a similar signal level and a similar background noise to those of the signal (third signal) received by the left ear is transmitted to the right ear of the listener through the speaker 230.

Subsequently, a case of using a bone conduction speaker unit for the speaker 230 is described.

In case of a bone conduction speaker unit, an audio signal transmitted to the microphone 220 is transmitted to the right ear. If the first signal transmitted to the left ear of the listener is indicated as $s_L(t)$ and the second signal transmitted to the right ear of the listener is indicated as $s_R(t)$, an output $y_R(t)$ of the speaker 230 before the compensation is expressed as shown by the following Formula 8.

$$y_R(t)=s_R(t)+hs_L(t)$$

In order to play a stereophonic sound, the section $hs_L(t)$ must be removed from the output of the speaker 230. After compensating a channel response estimated by channel response estimating unit 241 by using a compensation parameter determined both for the first signal and the second signal received through the wireless communication unit 210, a signal processed by removing two signal sections is output to the speaker 230. In this case, the fourth signal reaching the right ear is expressed as shown by the following Formula 9.

$$y_R(t)=\hat{h}s_R(t)-\hat{h}s_L(t)+hs_L(t)$$

According to Formula 9, a stereophonic sound can be played effectively because the section $hs_L(t)$ has been removed.

In the above description, a method for playing a stereophonic sound and a principal of operating a device have been described according to the present invention. The above description assumes that a listener wears the speaker 230 of the portable device at the right ear; however, the speaker 230 can be worn alternatively at the left ear. In this case, an audio signal output by the external speaker 122 is transmitted to the right ear of the listener.

According to the present invention, a stereophonic sound can be played by using a single speaker and one or more external speakers.

While the present disclosure has been shown and described with reference to various embodiments thereof, it will be understood by those skilled in the art that various changes in form and details may be made therein without departing from the spirit and scope of the present disclosure as defined by the appended claims and their equivalents.

The invention claimed is:

1. A method for playing a stereophonic (3D) sound by a portable device including a first speaker and a microphone, the method comprising:

receiving, through wireless communication, a first signal and a second signal from a media playing device, wherein the first signal is an audio signal including one of left direction information or right direction information and the second signal is an audio signal including the other of the left direction information or the right direction information;

receiving, through the microphone in the portable device, a third signal output by a second speaker in the media playing device, wherein the third signal includes an audio signal corresponding to the first signal and background noise;

determining a compensation parameter for a fourth signal by comparing the first signal and the third signal, wherein the fourth signal is to be output through the first speaker in the portable device and the fourth signal is corresponding to the second signal, the first speaker being worn at an ear of a user; and generating the fourth signal by applying the compensation parameter to the second signal.

2. The method of claim 1, wherein the determining of the compensation parameter comprises:

estimating a first imbalance parameter for a channel between the first speaker and the microphone;

estimating a second imbalance parameter for the background noise included in the third signal; and determining the compensation parameter based on the first imbalance parameter and the second imbalance parameter.

3. The method of claim 2, wherein the estimating of the first imbalance parameter is performed by comparing the first signal with the third signal, sampling a signal having a correlation with the first signal, and estimating the channel between the first speaker and the microphone.

4. The method of claim 2, further comprising:

estimating a third imbalance parameter for a signal intensity difference between the first signal and the third signal, wherein the determining of the compensation parameter is further based on the third imbalance parameter.

5. The method of claim 1, wherein the first speaker is a single speaker.

6. A method for playing a stereophonic (3D) sound by a media playing device, the method comprising:

transmitting, through wireless communication, a first signal and a second signal to a portable device, wherein the first signal is an audio signal including one of right direction information or left direction information and the second signal is an audio signal including the other of the right direction information or the left direction information;

outputting, through an external speaker in the media playing device, a third signal corresponding to the first signal;

receiving, through wireless communication, feedback information related to the first signal from the portable device, wherein the feedback information comprises channel response information based on the first signal and the third signal;

processing the first signal based on the channel response information; and outputting, through the external speaker, the processed first signal.

7. The method of claim 6, wherein the processing of the first signal comprises delaying the first signal for a predetermined time.

8. A portable stereophonic (3D) sound playing device, the device comprising:

a first speaker configured to be worn at an ear of a user;

a wireless communication unit configured to receive, from a media playing device, a first signal and a second signal, wherein the first signal is an audio signal including one of right direction information or left direction information and the second signal is an audio signal including the other of the right direction information or the left direction information;

a microphone configured to receive a third signal from a second speaker in the media playing device, wherein the third signal includes an audio signal corresponding to the first signal and background noise; and a signal processor configured to determine a compensation parameter for a fourth signal by comparing the first signal and the third signal, wherein the fourth signal is to be output through the first speaker and the fourth signal is corresponding to the second signal, and generate the fourth signal by applying the compensation parameter to the second signal.

9. The device of claim 8, wherein the signal processor comprises:

a first estimator configured to estimate a first imbalance parameter for a channel between the first speaker and the microphone;

a second estimator configured to estimate a second imbalance parameter for the background noise included in the third signal; and a compensation parameter determiner configured to determine the compensation parameter based on the first imbalance parameter and the second imbalance parameter.

10. The device of claim 9, wherein the first estimator estimates the channel between the first speaker and the microphone by comparing the first signal with the third signal and by sampling a signal having a correlation with the first signal.

11. The device of claim 9, further comprising:

a third estimator configured to estimate a third imbalance parameter for a signal intensity difference between the first signal and the third signal, wherein the signal processor considers the third imbalance parameter together when determining the compensation parameter.

12. The device of claim 8, wherein the first speaker is a single speaker.

13. A media playing device for playing a stereophonic sound, the device comprising:

a transceiver configured to:

transmit, to a portable device, a first signal and a second signal, wherein the first signal is an audio signal including one of right direction information or left direction information and the second signal is an audio signal including the other of the right direction information or the left direction information, and receive, from the portable device, feedback information related to the first signal, wherein the feedback information comprises channel response information based on the first signal and a third signal corresponding to the first signal; and an audio processor configured to:

output, through an external speaker in the media playing device, the third signal, and process the first signal based on the channel response information and output, through the external speaker, the processed first signal.

14. The device of claim 13, wherein the audio processor comprises a delay compensator configured to delay the first signal for a predetermined time.

* * * * *